United States Patent [19]

Van Diepenbroek et al.

[11] 3,970,437

[45] July 20, 1976

[54] ELECTRIC DUST SEPARATOR

[75] Inventors: Alfred Erich Wibrandt Van Diepenbroek, Ermelo; Jan Hendrik Wormgoor, Amersfoort; Cornelis Schilperoort, Ermelo, all of Netherlands

[73] Assignee: Bronswerk Apparatenbouw B.V., Nijkerk, Netherlands

[22] Filed: Mar. 4, 1974

[21] Appl. No.: 447,775

[30] Foreign Application Priority Data

Mar. 6, 1973 Netherlands ..... 7303156

[52] U.S. Cl. ..... 55/127; 55/149; 55/150; 55/155; 55/157; 55/459 R

[51] Int. Cl.[2] ..... B03C 3/14

[58] Field of Search ..... 55/127, 149, 150, 155, 55/157, 459 R

[56] References Cited

UNITED STATES PATENTS

| | | | |
|---|---|---|---|
| 1,650,097 | 11/1927 | Schmidt | 55/150 |
| 2,081,772 | 5/1937 | Saint Jacques | 55/127 |
| 2,711,226 | 6/1955 | Davis, Jr. | 55/127 |

FOREIGN PATENTS OR APPLICATIONS

| | | | |
|---|---|---|---|
| 714,367 | 7/1965 | Canada | 55/127 |
| 800,345 | 8/1958 | United Kingdom | 55/127 |

*Primary Examiner*—Bernard Nozick
*Attorney, Agent, or Firm*—Haseltine, Lake & Waters

[57] ABSTRACT

An electric dust separator, adapted to remove solid or liquid particles from a gas stream, comprises a separating space defined by two coaxial cylindrical walls. The gas stream to be purified flows through the separating space in a helical path. Dipole charges are induced in the particles to be removed by means of a radial electric field which is too weak to cause a substantial ionization of the gas. The electrodes generating the field are shaped and arranged in such manner that the field intensity increases from the inside to the outside, and that the field is locally concentrated at the outer wall, but homogeneous at the inner wall. The particles are agglomerated and move downwardly along the outer wall. There is only a slight adherence of particles to the outer wall. The helical flow of the gas stream is obtained either by tangentially introducing the stream in the separating space, or by a rotation of the separating space.

4 Claims, 8 Drawing Figures

ELECTRIC DUST SEPARATOR

BACKGROUND OF THE INVENTION

Figure 1:
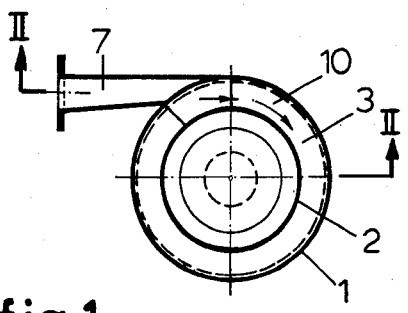

The invention relates to an apparatus for removing solid or liquid particles from a gas stream flowing in a helical path through a separating space bounded by two coaxial cylindrical walls, in which a radial unidirectional field is generated by means of electrodes associated with the cylindrical walls so that the particles move to the outside of the separating space by a cooperation of the centrifugal force and the electrostatic force.

An apparatus of this kind has been disclosed in British Pat. No. 487,547. However, this Patent does not indicate how the particles obtain the charge required for the electric separation.

In an apparatus for removing particles from a gas stream by means of an electric field, the field intensity has usually such a high value that a corona discharge occurs in the gas to be purified, whereby the gas is ionized and the particles to be removed are charged. The charged particles may now be removed from the gas stream by the attraction of the of the electrodes.

The use of a corona discharge has the disadvantage, however, that the electric circuits and their maintenance are relatively expensive and that not all particles may be removed from the gas stream. In fact, there is no effective separation if the resistivity of the particles is large, for instance larger than $10^{10}$ Ohm cm, because only a weak charge is obtained in this case, or if the particles have a low resistivity, for instance less than $10^4$ Ohm cm, because the change of polarity at the precipitation electrode occurs too rapidly in this case. Furthermore, it is necessary when a corona discharge is used to operate only slightly below the breakdown voltage, in order to obtain a reasonable efficiency. As a consequence there are frequent breakdowns causing interferences in radio and television receivers and a harmful generation of ozone. Also the voltage must frequently be adapted to the dirtying of the apparatus, whereby the danger of explosion occurs for certain kinds of dust.

In order to attain a corona discharge the field intensity in the separating space must lie above a critical value, which may be 10–20 kv/cm if the gas stream to be purified consists of air.

It has also been proposed to make use of a dipole effect in the electric purification of a gas stream. In this case the field intensity has such a low value that there is substantially no ionization in the gas stream and the separation is mainly based on the phenomenon that electric dipole charges are generated in the particles to be removed. This is of course always possible if the particles consist of an insulating material; however, a dipole charge may also be obtained in many cases for metallic particles, because they are often coated with an insulating oxide layer. For the dipole formation the field intensity must be smaller than the above-mentioned critical value if the gas stream consists of air. The proposal to use the dipole effect has not yet led to an industrial application, however.

BRIEF SUMMARY OF THE INVENTION

It is the main object of the invention to provide an effective apparatus for the purification of a gas stream which is based on the dipole effect.

It is another object of the invention to provide an electric dust separator in which the particles to be removed are driven to the outside of the separating space by a cooperation of the electrostatic force with the centrifugal force.

It is a further object of the invention to provide an electric dust separator in which the particles removed from the gas stream do not adhere to the outer wall of the separating space to any substantial extent.

It is a further object of the invention to provide an electric dust separator in which the particles removed from the gas stream are agglomerated to form larger particles that may be discharged by means of the gravitational force.

According to the invention, the intensity of the electric field has been selected in such manner that substantially no ionization occurs in the gas stream and the electrodes generating the electric field are shaped and arranged in such manner that the field intensity increases from the inner wall to the outer wall and that the field is locally concentrated at the outer wall, whereas no local concentration occurs at the inner wall, in such manner that the particles moving to the outside in the separating space are combined to progressively larger agglomerates and are at least partially removed from the separating space along the outer wall.

Because the field intensity in the separating space increases from the inside to the outside in the apparatus according to the invention the charged particles move to the outside. If two particles collide during this movement there occurs an agglomeration so that a larger dipole is formed, which has a stronger tendency to move in the direction of the largest field intensity and which is subject to a stronger centrifugal force due to the larger mass. Thus, the agglomerates that have been formed move progressively to the outside.

Due to the local concentration of the field at the outer wall the agglomerated particles are confined to a progressively decreasing space, whereby the agglomeration is enhanced.

By this effect, the particles obtain such dimensions that they move downwardly along the outer wall in the shape of a coarse cohering matter. This leads to a very effective separation, wherein the adherence of the particles to the outer wall is only slight.

The local concentration of the electric field at the outer wall may be obtained in various ways. In a first embodiment, the outer wall is made of an insulating material and carries a plurality of parallel axially directed separate electrodes having the same potential. In a second embodiment the outer wall is likewise made of an insulating material and carries a continuous helical electrode. In both cases the said electrodes are preferably arranged on the inside of the outer wall. In order to reduce the chance of a corona discharge it is preferred to provide an insulating coating on the electrode or electrodes.

The chance of a corona discharge may also be reduced by arranging the electrode or electrodes pertaining to the outer wall on the outside of this wall. In this case it is also preferable to use an insulating coating in order to avoid a dust disposal on the electrode or electrodes.

Figure 3:
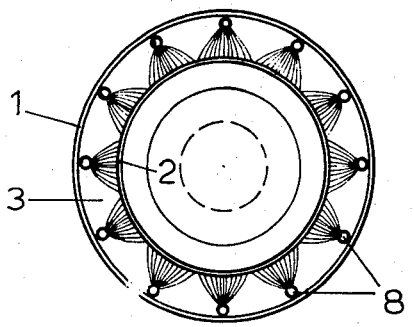

Since there should be no local concentration on the inner wall, the inner wall is preferably a homogeneous cylinder.

erated between the walls 1 and 2; the lines of force of this field are shown in FIG. 3; and the field intensity increases from the inner wall to the outer wall and is locally concentrated at the outer wall.

The gas to be purified is introduced in the space 3 through the inlet channel 7 and is forced by a partition 9 to flow through the space 3 along a helical path, as schematically indicated by the arrows 10. This helical flow of the gas between the cylindrical walls 1 and 2 gives rise to a turbulence; in addition, a centrifugal force is exerted on the particles suspended in the gas. Due to the electric field in the space 3, dipole charges are induced in the particles so that they have the tendency to follow the lines of force of the field in the direction of the outer wall 1. This effect of the electric field is amplified by the centrifugal force exerted on the particles. Due to the turbulence, the particles collide with each other in which case they are combined to larger dipoles, which are attracted by the outer wall 1 to a larger extent. At the same time the mass of the particles is progressively increased so that the influence of the centrifugal force is also increased.

In this manner, the particles suspended in the gas are combined into larger particles 11, which move downwardly along the outer wall 1 and finally leave the space 3 through the funnel-shaped portion 4 and the outlet opening 12, as schematically indicated by the arrows 13. The purified gas leaves the space 3 through the inside of the inner wall 2 and the sleeve 5, after which it is discharged through the outlet opening 14, as indicated by the arrows 15. The bottom of the inner wall 2 is provided by a thick collar 23 made of a synthetic material and serving to prevent an undesired field concentration in the flow.

Figure 4:
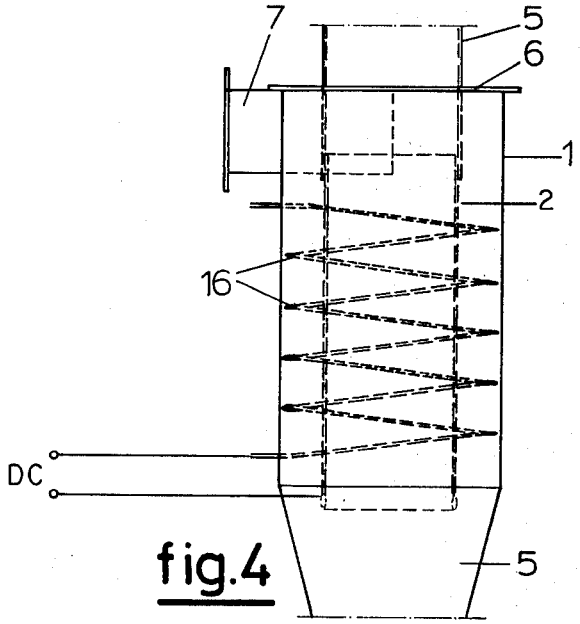

In the embodiment according to FIG. 4 an electrode shaped as a helical winding 16 is arranged on the inside of the outer wall. The electric field in the space 3 is thereby turned with respect to the course of the lines of force as shown in FIG. 3; however, this has no influence on the operation of the apparatus.

Figure 5:
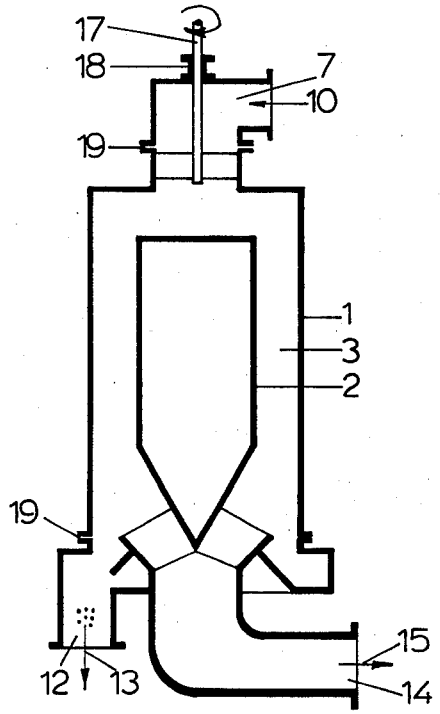

In the embodiment shown in FIG. 5 the gas to be purified is introduced into the space 3 through the inlet channel 7 at the top. The gas is forced to flow through the space 3 in a helical path, because it is taken along by the rotating outer wall 1. For this purpose, the outer wall is provided with a driving shaft 17 supported by a bearing 18 in the stationary portion of the apparatus. Gaskets 19 are provided between the rotating wall 1 and the stationary parts of the apparatus. The separated particles leave the apparatus through the outlet opening 12 as indicated by the arrow 13, and the purified gas leaves the apparatus through the outlet opening 14, as indicated by the arrow 15. The electrodes 8 and 16 may be fixed to the outer wall 1 in the same manner as in the abovementioned embodiments and in this case they are connected with a voltage source by means of a slip ring or the like. It is also possible, however, to arrange the electrodes at some distance from the outer wall 1 and in this case they may be stationary, if desired.

Figure 2:
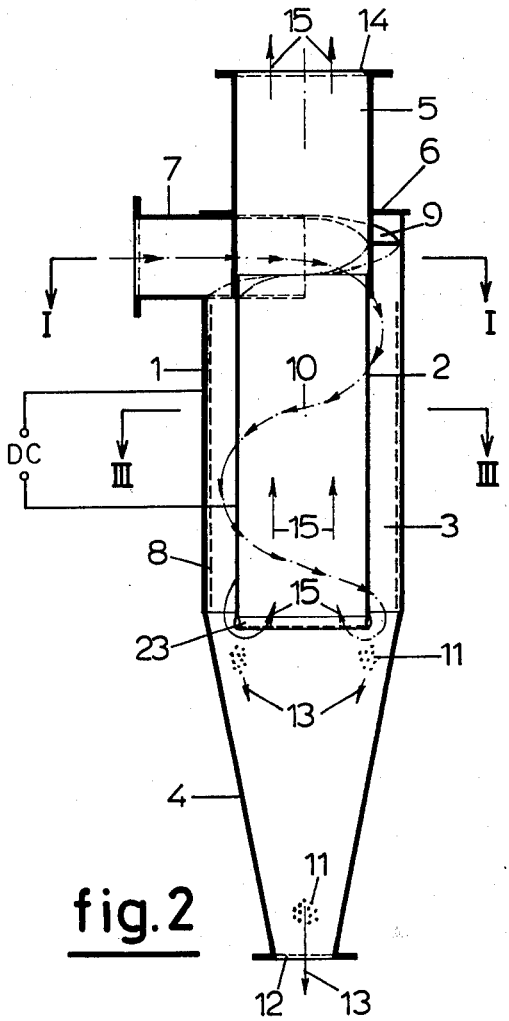
Figure 6:
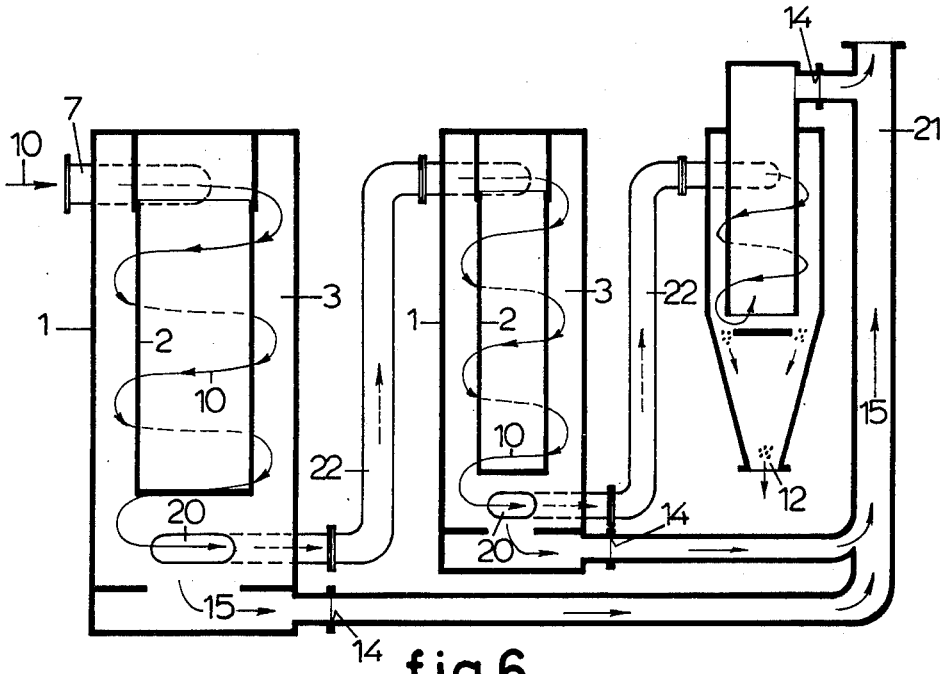

The apparatus as shown in FIG. 6 comprises three stages, each carried out as indicated in FIG. 1; however, the two first stages are slightly different from FIG. 1. In fact, the inner wall 2 is closed at its bottom in the two first stages and a tangential opening 20 is provided underneath the inner wall 2 to discharge the outer layer of the gas containing the separated particles; the opening 20 is connected with a succeeding stage through a conduit 22. The gas to be purified is introduced into the first stage through the inlet channel 7, as described with reference to FIGS. 1 and 2. The separated particles leave the apparatus through the outlet opening 12. The purified gas leaves each of the stages through the outlet opening 14 and is discharged through a collecting circuit 21. Each following stage may have smaller dimensions than the preceding stage.

In each of the embodiments as described the difference of potential between the inner wall 2 and the electrode or electrodes of the outer wall 1 may amount for instance to 1–100 *kv*. If the separated particles are disposed on the outer wall 1, the difference of potential may be periodically varied. During the intervals, in which a small difference of potential occurs, the particles are released so that they are discharged in downward direction by the gas stream and the gravitation.

Figure 7:
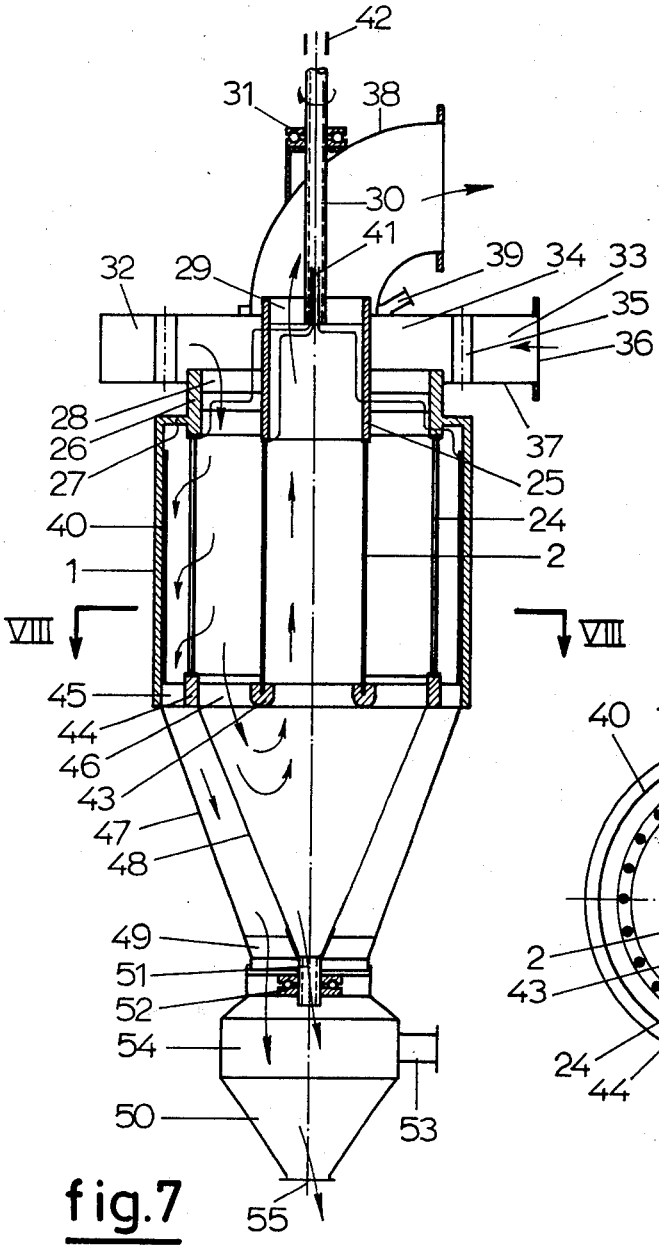
Figure 8:
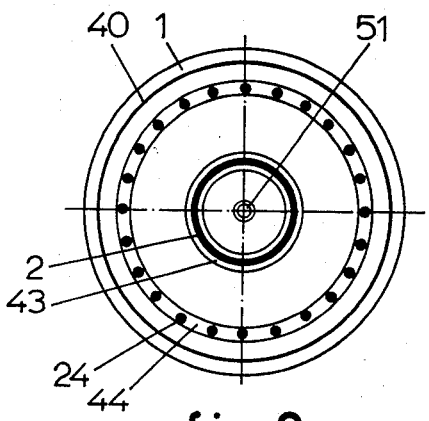

FIGS. 7 and 8 show an embodiment according to the invention, in which the entire separating space is rotated. The rotating portion of the apparatus comprises inter alia the outer wall 1, made of an insulating material, the metallic inner wall 2 and a plurality of conductive rods 24 arranged in the space between the walls 1 and 2 and being nearer to the outer wall 1 than to the inner wall 2. The rods 24 form a ring coaxial with the cylindrical walls 1 and 2 and have all the same potential different from the potential of the inner wall 2 so that a radial unidirectional electric field occurs between the inner wall 2 and the rods 24, of which the intensity increases from the inside to the outside and which is locally concentrated in the vicinity of each of the rods 24. The outer wall 1, the rods 24 and the inner wall 2 are mechanically interconnected so that the entire assembly may be integrally rotated.

For this purpose, the top of the inner wall 2 is connected with an inner sleeve 25 made of an insulating material and the tops of the rods 24 are connected with an outer sleeve 26 likewise made of an insulating material. The outer wall 1 is connected with the outer sleeve 26 by means of a horizontal flange 27, while the inner sleeve 25 and the outer sleeve 26 are interconnected by a plurality of radially directed support members 28 carried out as spokes. The inner sleeve 25 is connected by means of similar support members 29 with a hollow shaft 30 supported in a bearing 31 and driving the assembly.

The gas to be purified is introduced into the separating space by means of a drum-shaped gas supply member 32 arranged above said space and pertaining to the stationary portion of the apparatus. The gas supply member 32 comprises two coaxial chambers 33 and 34 separated from each other by a blade rim 35. The gas enters the outer chamber 33 through an opening 36 and reaches the inner chamber 34 communicating with the separating space between the walls 1 and 2 through the blade rim 35. For this purpose, the outer sleeve 26 extends through the bottom wall 37 of the gas supply member and the inner sleeve 25 extends through the entire gas supply member and is connected at its top with a stationary outlet section 38, through which the purified gas is discharged. Gaskets, for instance of the labyrinth type (not shown), are provided between the rotating sleeves 25 and 26 on one side and the gas supply member 32 on the other side. Through a channel 39 a purified gas stream is supplied to the gas supply member 32 in order to prevent the incoming unpurified gas from reaching the inside of the inner sleeve 25, in which case it would be discharged through the section 38. The hollow shaft 30 extends through the wall of the section 38.

The incoming gas to be purified is brought into rotation by the blade rim 35 in such manner that the speed of rotation of the gas upon leaving the supply member 32 corresponds substantially to the speed of rotation of the separating space. The gas is kept in rotation by the rotating movement of the separating space so that it flows in a helical path. The electric field between the inner wall 2 and the rods 24 induces a dipole charge in the dust particles suspended in the gas, whereby the particles more in the direction of increasing field intensity, i.e. from the inside to the outside, and are combined into agglomerates. The agglomerates arrive through the spaces between the rods 24 in the space between these rods and the outer wall 1, which is substantially free of turbulence. It is thereby prevented that the agglomerates are destroyed by the turbulence. The movement of the particles to the outside is supported by the centrifugal force.

The outside of the outer wall 1 carries through a portion of its axial length a conductive coating 40, which is periodically brought onto the potential of the inner wall 2 during a short time. The agglomerates, which may have adhered to the outer wall 1, are removed in this manner so that all agglomerates leave the apparatus through the space between the rods 24 and the outer wall 1.

The gas in the space between the rods 24 and the inner wall 2, which comprises only a slight amount of impurities due the separation of the dust particles, leaves the separating space at its bottom and is led to the outlet section 38 through the inside of the inner wall 2 and the inner sleeve 25.

The required electric voltages are supplied to the apparatus by means of a cable 41 extending through the inside of the hollow shaft 30 and connected to a high voltage source by means of a schematically indicated transfer member 42, which may be provided with slip rings.

The bottom of the inner wall 2 is connected with an inner ring 43 made of an insulating material, while the bottoms of the rods 24 are connected with an outer ring 44 also made of an insulating material; the outer ring 44 is connected by means of radially directed supporting members 45 with the outer wall 1 and by means of similar supporting members 46 with the inner ring 43. The rods 24 are electrically interconnected by means of conductive layers applied to the bottom of the outer sleeve 26 and to the top of the outer ring 44. The bottom of the outer wall 1 is connected with a conical outer partition 47 and the outer ring 44 is connected with a conical partition 48; both partitions rotate together with the separating space. The partitions 47 and 48 are interconnected by means of radially directed supporting members 49 carried out as spokes. The separated dust particles flow through the space between the partitions 47 and 48 and are received gy a stationary dust chamber 50. A gasket has been provied between the inner partition 47 and the dust chamber 50. The purified gas is discharged from the space between the inner wall 2 and the rods 24 through the space enclosed by the conical partition 48. If there are dust particles in said last-mentioned space, they may reach the dust chamber 50 through a hollow shaft 51 connected with the bottom of the conical partition 48 and supported in a bearing 52. The transport of these dust particles is enhanced by connecting the dust chamber 50 through a channel 53 with a vacuum source so that the dust particles are sucked into the dust chamber. The amount of the purified gas leaving the apparatus through the hollow shaft 51 is negligible with respect to the main stream discharged through the outlet section 38.

The dust chamber 50 is provided with an enlarged portion 54, in which the dust particles may settle to some extent and with a dust outlet 55 at its bottom.

We claim:

1. An apparatus of the dipole separator type for removing dust particles from a gas stream, comprising a metallic cylindrical inner wall constituting a first electrode; a coaxial cylindrical outer wall formed of an electrically insulating material; a second electrode carried by said outer wall and comprising a plurality of parallel, axially directed, electrically interconnected electrodes formed of a conducting material coated with an electrically insulating material to prevent the formation of a corona discharge; a source of electrical potential connected to said first and second electrodes for generating a difference in electrical potential between said first and second electrodes so that a unidirectional electric field is formed between said first and second electrodes, the intensity of said electric field increasing from said inner wall toward said outer wall and being locally concentrated at said outer wall but homogeneous at said inner wall; said walls defining therebetween a separating space having a main axis, an inlet end and an outlet end; and means at said inlet end for introducing a gas stream into said space so that the same flows through said space in a helical path.

2. The apparatus as defined in claim 1, wherein said introducing means includes means for tangentially leading the gas stream into said separating space at an angle with said axis of the latter.

3. An apparatus of the dipole separator type for removing dust particles from a gas stream, comprising a metallic cylindrical inner wall constituting a first electrode; a coaxial cylindrical outer wall formed of an electrically insulating material; a continuous, helical second electrode carried by said outer wall and formed of a conducting material coated with an electrically insulating material to prevent the formation of a corona discharge; a source of electrical potential connected to said first and second electrodes for generating a difference in electrical potential between said first and second electrodes so that a unidirectional electric field is formed between said first and second electrodes, the intensity of said electric field increasing from said inner wall toward said outer wall and being locally concentrated at said outer wall but homogeneous at said inner wall; said walls defining therebetween a separating space having a main axis, an inlet end and an outlet end; and means at said inlet end for introducing a gas stream into said space so that the same flows through said space in a helical path.

4. The apparatus as defined in claim 3, wherein said introducing means includes means for tangentially leading the gas stream into said separating space at an angle with said axis of the latter.

* * * * *